United States Patent [19]

Stikeleather

[11] 4,319,475

[45] Mar. 16, 1982

[54] CENTER-SPINE MOUNTED TANDEM CANTILEVERED ROLLING MILL

[76] Inventor: Allan Stikeleather, 25 Greenlodge St., Canton, Mass. 02021

[21] Appl. No.: 159,135

[22] Filed: Jun. 13, 1980

[51] Int. Cl.[3] ..... B21B 31/02

[52] U.S. Cl. ..... 72/234; 72/237

[58] Field of Search ..... 72/234, 237, 181, 249, 72/160, 165

[56] References Cited

U.S. PATENT DOCUMENTS 2,468,151 9/1969 Drolot ..... 72/234

3,595,056 7/1971 Hutton ..... 72/181

*Primary Examiner*—Lowell A. Larson

*Attorney, Agent, or Firm*—Parmelee, Johnson, Bollinger & Bramblett

[57] ABSTRACT

A center-spine mounted tandem cantilevered rolling mill includes three or more pairs of upper and lower spindles. An elongated rigid center spine extends horizontally midway between the upper and lower spindles. The upper spindles are removably mounted above this center spine by upper front and rear bearings, with their axes extending parallel and oriented perpendicular to the length of the spine. The front ends of the upper spindles project forward centilevered beyond the spine for carrying the upper work rolls. The lower spindles are removably mounted below this center spine by lower front and rear bearings in alignment with the respective upper spindles. The front ends of the lower spindles project forward cantilevered beyond the spine for carrying the lower work rolls. Each pair of upper and lower work rolls is called a "stand". By virtue of this spine located symmetrically mid-way between and closely coupled to the spindles, the interstand forces and stresses created by dynamics of tandem rolling are nullified or cancelled out in the spine, thereby isolating respective spindles from rolling stresses occuring in neighboring spindles. The forces to which each stand is subjected include overturning and skewing moments and separating forces caused by passage of stock between work rolls. All spindles are independently accessibly mounted. Thus, either upper or lower spindle in each stand can advantageously be removed without removing the other. A lighter, more compact rolling mill is provided having the same ratings as a heavier, bulkier prior art mill.

8 Claims, 5 Drawing Figures

CENTER-SPINE MOUNTED TANDEM CANTILEVERED ROLLING MILL

FIELD OF THE INVENTION

This invention is in the field of multiple stand tandem rolling mills of the cantilever type having three or more stands, each stand including an upper and a lower spindle for carrying an upper and a lower work roll, respectively.

BACKGROUND OF THE INVENTION

In multiple stand tandem rolling mills of the cantilever type as constructed in the prior art all of the spindles are mounted on top of a strong, heavy table with the bearings for the upper spindles mounted on top of the bearings for the lower spindles, as shown in FIG. 1.

If it becomes necessary to remove and replace a lower spindle or either of its bearings, in such a prior art mill it is necessary first to remove the upper spindle and its bearings, because access to the components of the lower spindle in each stand cannot be obtained until the corresponding upper spindle has been removed from its mounted position on top of the lower spindle.

As used herein the following terms have the following meanings:

The "stock" is the metal material being rolled.

The "pass line" is the straight line through the mill along which the stock is travelling as it is being rolled.

A "tandem" rolling mill is a mill in which the stock travels along a pass line through multiple stands in sequence.

A "cantilever" rolling mill is a mill in which the work rolls are mounted on portions of the respective spindles which project in cantilevered relationship beyond the front bearings. In other words, the front bearing is positioned on its spindle between the rear bearing and the location of the work roll on the spindle.

In such prior art multiple stand tandem cantilever rolling mills in which the bearings in the upper spindles are mounted on top of the bearings for the lower spindles which, in turn, are mounted on the table, the interstand forces which are created as a result of the dynamics of rolling exert powerful overturning moments on the respective stands, because the stands loom up in tower-like fashion relatively high above the table top. Consequently, the table must be made very strong and rigid to resist these powerful overturning moments. As shown in FIG. 1, the prior art table was a double-layered table with a pair of vertical webs between the two layers of the table for providing the requisite stiffness. In effect, this prior art table was a large box beam of generally rectangular cross sectional configuration.

In addition to the overturnings moments, the interstand forces generated through the dynamics of rolling exert moments on each stand tending to skew the stand about a vertical axis. Such skewing moments are created because the work rolls are positioned on the spindles in cantilevered relationship with respect to the front and rear bearings. A disadvantage of such prior art table-mounted mills is that the skewing forces on the upper spindles are added to the skewing forces directly induced in the lower spindles, thereby increasing the stresses which must be borne by the lower spindles and their bearing mounts and thereby increasing the spindle deflections which may occur. Since the upper spindles are mounted relatively high above the table top in such prior art mills, relatively long fastening studs or long fastening bolts are inherently involved, and therefore the various stresses can cause significant deflections to occur. In other words, the upper spindles are not closely coupled to the table and so it is difficult for their relatively long fastening members to resist significant deflection under stress.

Further, during rolling, the stock exerts a separating force between the upper and lower work rolls in each stand. In such prior art table-mounted mills the upper spindle bearings transfer these separating stresses through relatively long fastening members to the lower spindle bearing mounts, thereby further increasing the stresses which must be borne by the lower spindles and their bearing mounts.

In summary, the prior art rolling mill as shown in FIG. 1 is commercially successful. However, the present invention provides a number of important technological advantages as described below.

SUMMARY OF THE ADVANTAGES OF THE PRESENT INVENTION

In a center-spine mounted tandem cantilever rolling mill embodying the present invention an elongated rigid center spine extends horizontally midway between the upper and lower spindles with a support frame for supporting this center spine in a horizontal position above the floor. The upper spindles are removably mounted above this center spine by means of upper front and rear bearings, with the axes of the upper spindles extending parallel with each other. Each upper spindle is oriented perpendicular to the length of the spine, and the front ends of the upper spindles project forward in cantilevered relationship beyond the spine for carrying the respective upper work rolls. The lower spindles are removably mounted below this center spine by means of lower front and rear bearings, with the lower spindles being positioned below and in alignment with the respective upper spindles. The front ends of the lower spindles project forward in cantilevered relationship beyond the spine for carrying the respective lower work rolls.

By virtue of having this center spine, which supports all of the spindle bearings, located in symmetrical position mid-way between the upper and lower spindles, the interstand forces and stresses created in the respective spindles as a result of the dynamics of the tandem rolling mill are nullified or cancelled out in the center spine. Each spindle is advantageously closely coupled to the center spine, because the respective upper and lower spindles are all positioned close to this center spine and are rigidly fastened to it by relatively short fastening members that are inherently stiffer than the much longer fastenings in the prior art.

Thus, advantageously, each individual spindle is closely coupled to the center spine in rigid fastened relationship, thereby isolating the respective spindles from the rolling stresses ocurring in neighboring spindles.

Furthermore, this center-spine mounting provides an advantageous independent mounting for each spindle with greater accessibility to each and every spindle so that either the upper or lower spindle in each stand can be removed without first removing the other spindle.

A lighter and more compact rolling mill is provided by this invention, and yet it has the same or better ratings as compared to a heavier, bulkier prior art mill.

In addition, by virtue of the close coupling between each spindle and the center spine, an overall relatively rigid mill structure is provided in spite of its reduced bulk and weight.

Considerable savings in materials with consequent savings in smelting and refining energy and substantial savings in manufacturing labor are achieved by this invention, and the lighter weight of the resultant compact mill saves shipping costs and fuel.

BRIEF DESCRIPTION OF THE DRAWINGS

The various features, objects, aspects and advantages of the present invention will be more fully understood from a consideration of the following description of an illustrative embodiment in conjunction with the accompanying drawings, in which like reference numbers are used to indicate the same components throughout the various views. In these drawings:

FIG. 5 is sectional view taken along the line 5—5 in FIG. 4.

In FIG. 1 is shown a prior art multi-stand tandem cantilever rolling mill 10 which is mounted on a table frame 12, including an upper table plate 14 and a lower table plate 16 interconnected by a pair of parallel vertical webs 17 and 18 and supported by legs 20 with appropriate diagonal bracing 15. The table plates 14 and 16 with their interconnecting webs 17 and 18 in effect form a massive box beam of generally rectangular configuration. The cantilevered ends of the upper and lower spindles 21 and 22 carry the upper and lower work rolls 23 and 24, respectively. It is noted that the upper work roll 23 is a male roll engaging the stock 25, which is being rolled between the flanges of the lower female roll 24.

Figure 1:
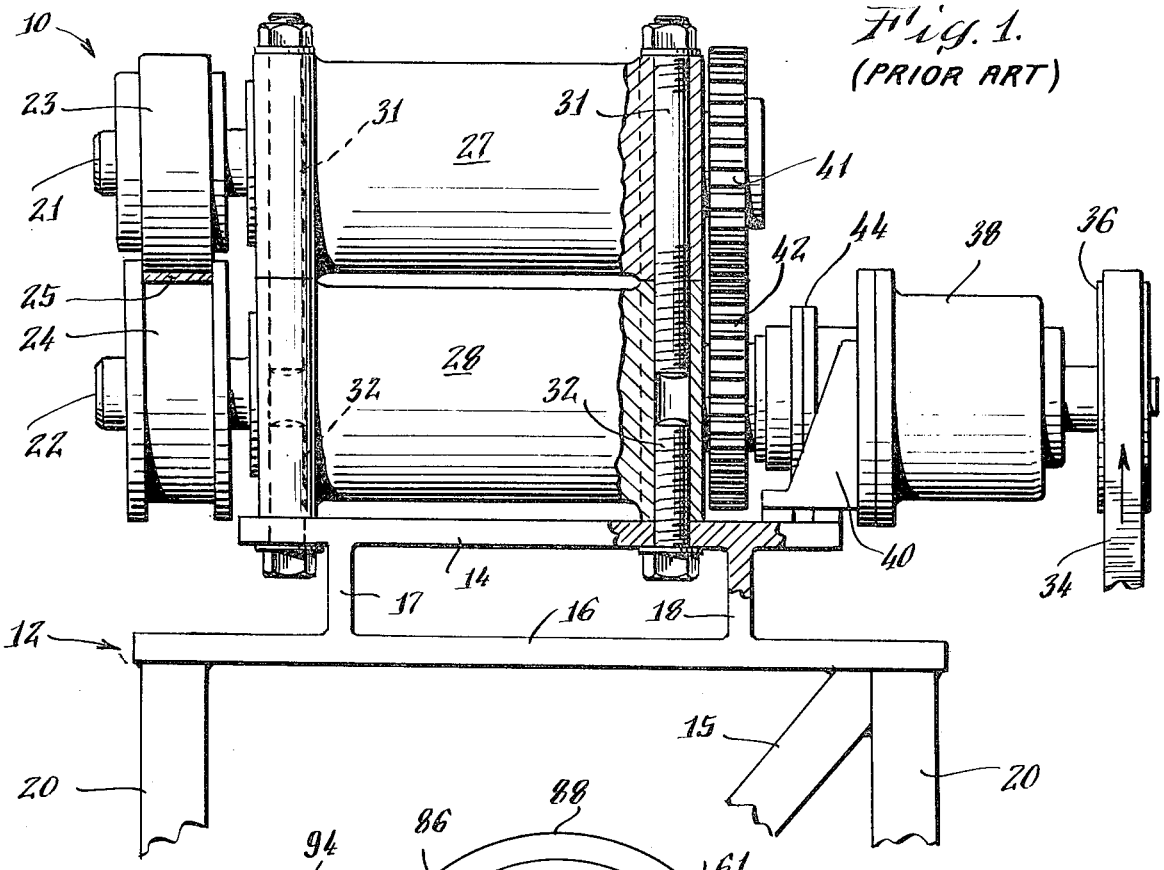
Fig. 1. (PRIOR ART)
FIG. 1 is an end view of a prior art table-mounted tandem cantilever rolling mill, shown partly in section, and with a gear cover removed for clarity of illustration. This view is seen from the input end of the mill.

Surrounding the upper and lower spindles 21 and 22 are upper and lower spindle housings 27 and 28, respectively. There are upper front and rear bearings (not seen) held in bearing mounts in the respective front and rear ends of the upper spindle housing 27 for rotatably supporting the upper spindle 21. Similarly, there are lower front and rear bearings (not seen) held in bearing mounts in the respective front and rear ends of the lower spindle housing 28.

The "front bearings" may also be called the "work roll bearings", because they are located near the cantilevered end portions of the spindles carrying the work rolls. Also, the "rear bearings" may be called the "drive side bearings", because they are located near the end portions on the spindles to which the driving torque is applied.

Fastening members 32 in the form of bolts serve to attach the front and rear bearing mounts of the lower spindle 22 to the upper plate 14 of the table frame, 12. Relatively long fastening members 31 in the form of studs (bolts may be used if desired) serve to attach the front and rear bearing mounts of the upper spindle 21 onto the bearing mounts of the lower spindle. It is noted that there are spaced cut out regions in the web 18 to provide access to the heads of the lower fastening bolts 32 of the various stands.

The drive for rotating the two spindles in opposite directions includes a power input belt 34 trained around a pulley sheave 36 on the input shaft of a planetary speed-reducing gear unit 38 fastened by a bracket 40 to the upper table plate 14. The output shaft of the planetary gear unit 38 is connected by a shaft coupling 44, for example a Browning coupling, to the rear end of the lower spindle 22.

In order to counter-rotate the upper spindle 21 at the same rotational speed as the lower spindle, there are a pair of mating gears 42 and 41 of the same diameter mounted on the lower and upper spindles 22 and 21, respectively.

Although such a prior art mill as shown in FIG. 1 is commercially successful, I now conceive that a considerably more advantageous mill structure can be provided having a center-spine mounting arrangement as indicated in the introduction and as will be described in detail further below.

In the prior art mill 10, if it becomes necessary for maintenance or servicing purposed to remove and replace a lower spindle 22 or either of its bearings, it is necessary first to remove the upper spindle housing 27, the upper spindle 21 and its bearings, because access to the components of the lower spindle in each stand cannot be obtained until the corresponding upper spindle components have been removed from their mounted position on top of the lower spindle.

During rolling the stock 25 can exert powerful interstand tension forces between the neighboring stands as created by the dynamics of the rolling operation, depending upon the hardness, strength and cross-sectional area of the stock and also depending upon such factors as the relative severity of the reduction being taken in each successive stand in the mill and the relative peripheral speeds of the work rolls in the respective stands. The interstand tension forces in the stock 25 can exert powerful overturning moments on a stand as shown, because the stand, including the spindles 21 and 22 and their housings 27 and 28, looms up in tower-like fashion relatively high above the table top.

Consequently, the table frame 12 was made very strong and rigid, as shown in FIG. 1 to resist bending under the effects of these powerful overtuning moments.

In addition to such overturnings moments, the interstand forces exerted by tension in the stock 25 tends to skew the stand out of position. A disadvantage of such prior art table-mounted mills 10 is that the skewing forces on the upper spindle 21 are added to the skewing forces directly induced in the lower spindle 22 thereby increasing the stresses which must be borne by the lower bearing mounts and lower spindle, thereby increasing the spindle deflections which may occur. Since the upper spindle 21 is mounted relatively high above the table top in such prior art mills, relatively long fastening members 31 (studs or bolts) are inherently involved. Thus, such stresses as described here can cause significant deflections to occur in these relatively long fastening members 31. In other words, the upper spindle 21 is not closely coupled to the table frame 12, and so it is difficult for its relatively long fastening members 31 to resist significant deflection under stress. Moreover, the stresses in the upper spindle fastening members 31 are transferred directly into the lower spindle bearing mounts causing an accumulation of stresses nad deflections in the lower spindle 33 and its bearing mounts.

Figure 2:
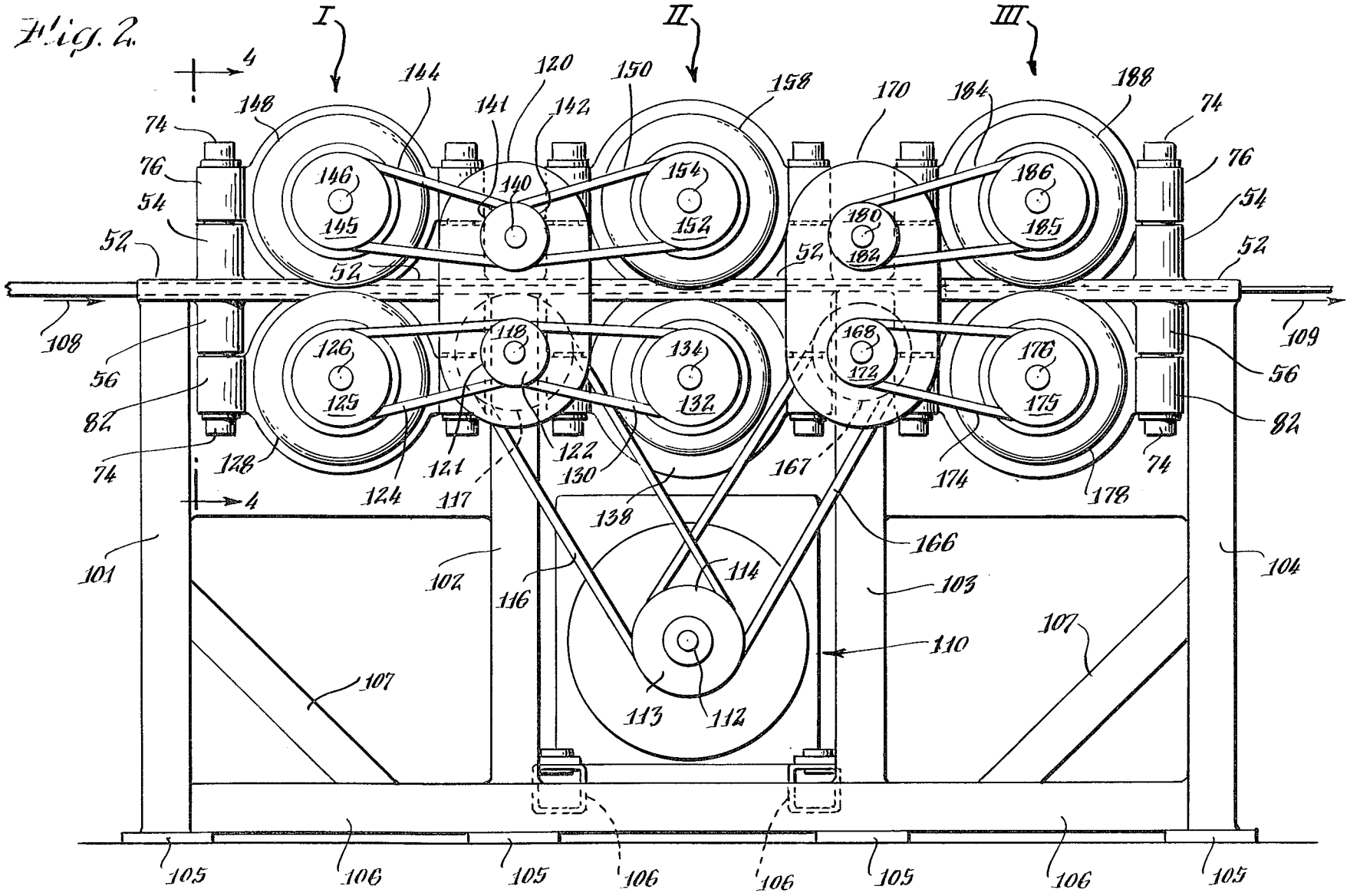
FIG. 2 is an elevational view of the drive side (also called the "rear" side) of a center-spine mounted tandem cantilever rolling mill embodying this invention.
Figure 3:
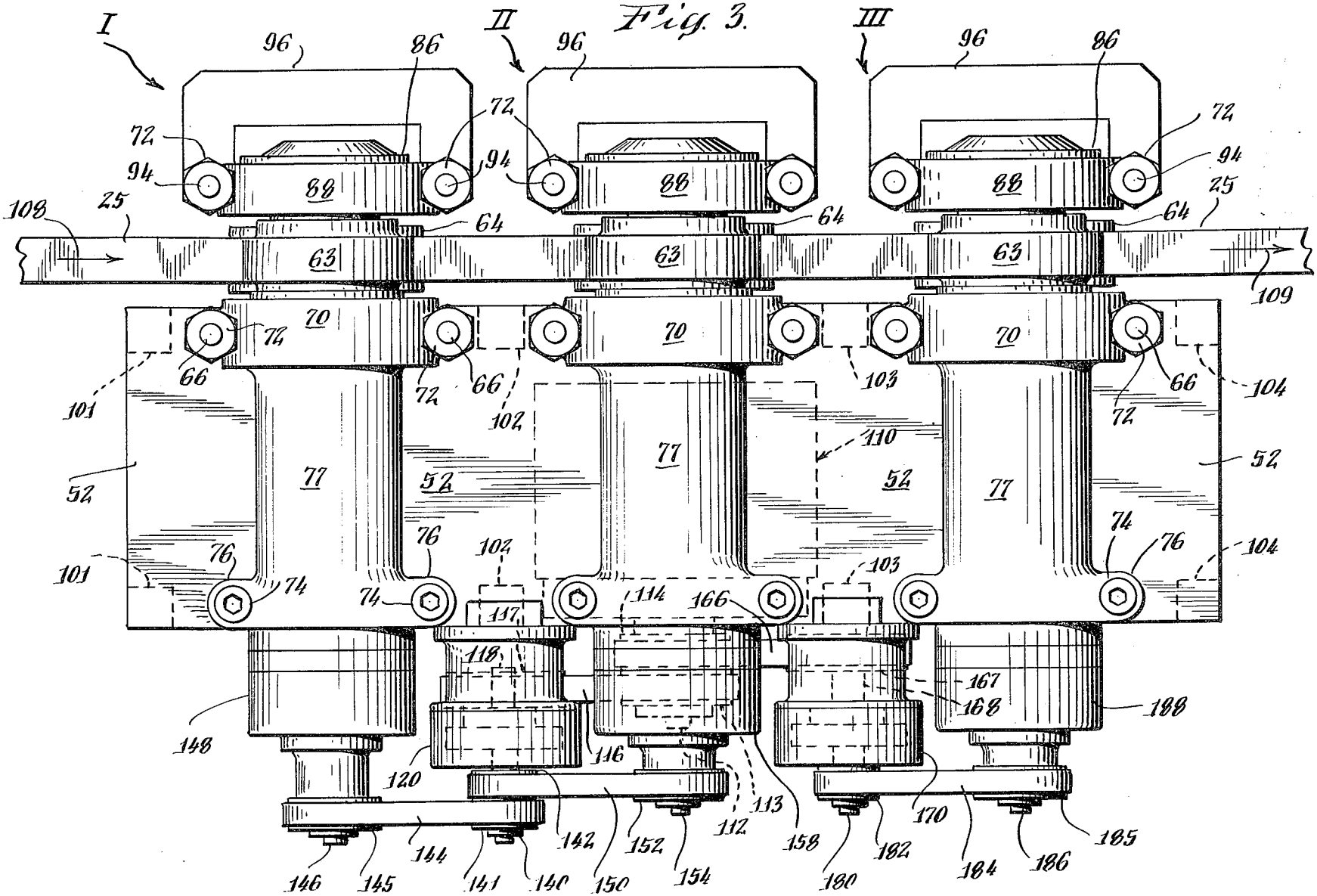
FIG. 3 is a top plan view of the mill shown in FIG. 2.
Figure 4:
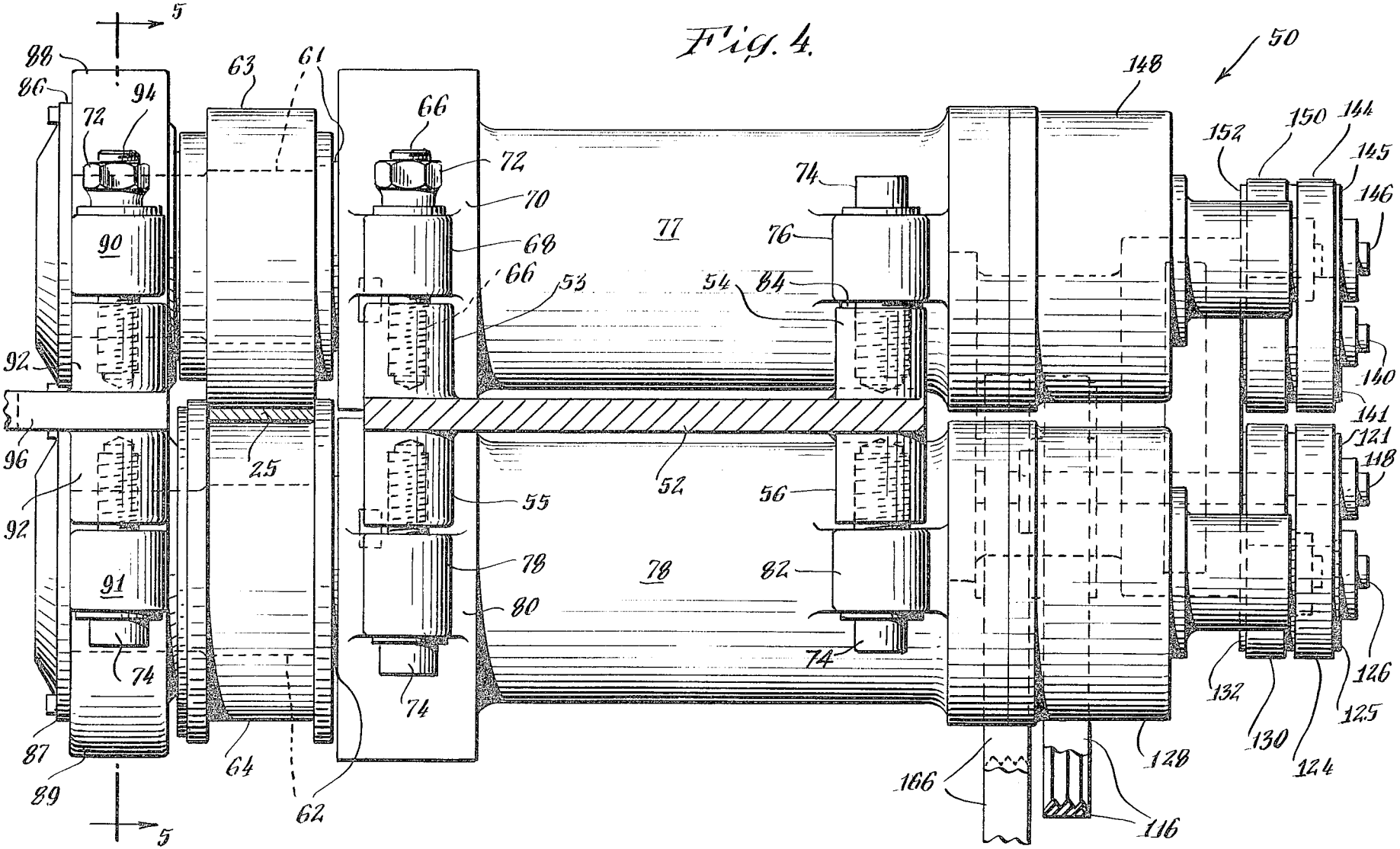
FIG. 4 is an end elevational view, shown somewhat enlarged, of the mill of FIGS. 2 and 3, as seen from the input end of the mill.

Turning attention to FIGS. 2, 3 and 4, there is shown a center-spine mounted tandem cantilever rolling mill 50. This improved mill 50 has a center spine 52 which is in the general form of a long horizontal rectangular plate positioned mid-way between the upper and lower spindles 61 and 62. The cantilevered end portions of the upper and lower spindles 61 and 62 carry the upper and lower work rolls 63 and 64, with the stock 25 which is being rolled located between the flanges of the lower roll 64.

In order to mount these two spindles 61 and 62 in closely coupled relationship directly to the center spine 52, there are pairs of upper and lower front and rear bosses 53, 54, 55 and 56 welded onto the top and bottom surfaces of this center spine 52. These bosses 53, 54, 55 and 56 can be called "stand offs". The two upper front bosses 53 (only one is seen in FIG. 4) each contain a stud 66 extending up through a hole in an ear 68 welded onto or integrally cast on the upper front bearing mount 70. A self-locking nut 72 on the upper end of each stud 66 adjustably secures the upper spindle 61 in its desired position relative to the lower spindle 62. A suitable self-locking nut 72 for this application, for example is a "FLEXLOC" heavy duty hexagonal locknut which is manufactured by Standard Pressed Steel Co. and is commercially available from G. R. Armstrong Manufacturers Supply, Inc. in Billerica, Mass.

The two upper rear bosses 54 (only one is seen in FIG. 4) each receive a self-locking bolt 74 passing down through an ear 76 welded onto or integrally cast on the upper spindle housing 77 near its rear end in the vicinity of the bearing which supports the rear end of the upper spindle 61. A suitable self-locking bolt for this application, for example, is a "LOC-WEL" self-locking socket head cap screw manufactured by Standard Pressed Steel Co. and commercially available from the supplier mentioned above.

The two lower front bosses 55 (only one is seen) each receive a self-locking bolt 74 passing up through an ear 78 welded onto or integrally cast on the lower front bearing mount 80.

The two lower rear bosses 56 (only one seen) each receive a similar self-locking bolt 74 passing up through an ear 82 welded onto or integrally cast on the lower spindle housing 78 near its rear end in the vicinity of the bearing which supports the rear end of the lower spindle 62.

When installing these fastening members as described above, the four lower self-locking bolts 74 for holding the lower spindle are drawn up tightly to seat the two front and two rear ears 78 and 82 rigidly up against their respective mounting bosses 55 and 56. In FIG. 4 a slight space is shown for clarity of illustration between the ear 78 and boss 55 and between the ear 82 and boss 56, but in actual practice they are tightly seated as described.

Then, a shim 84 of appropriate thickness is placed between each ear 76 and its mounting boss 54, and the two self locking bolts 74 are tightened. The two locknuts 72 are tightened to produce the desired spacing between the working surfaces of the work rolls 63 and 64. The thickness of the shim 84 should be the amount that will cause the axes of the two spindles 61 and 62 to be aligned exactly parallel, when the desired spacing between the work roll surfaces is obtained by adjusting the two self-locking nuts 72. It is important that the spindle axes be parallel. If they are nonparallel, the work rolls will exert greater squeezing force against one or the other edge region of the stock 25, thereby causing undesired camber to occur in the rolled product.

Figure 5:
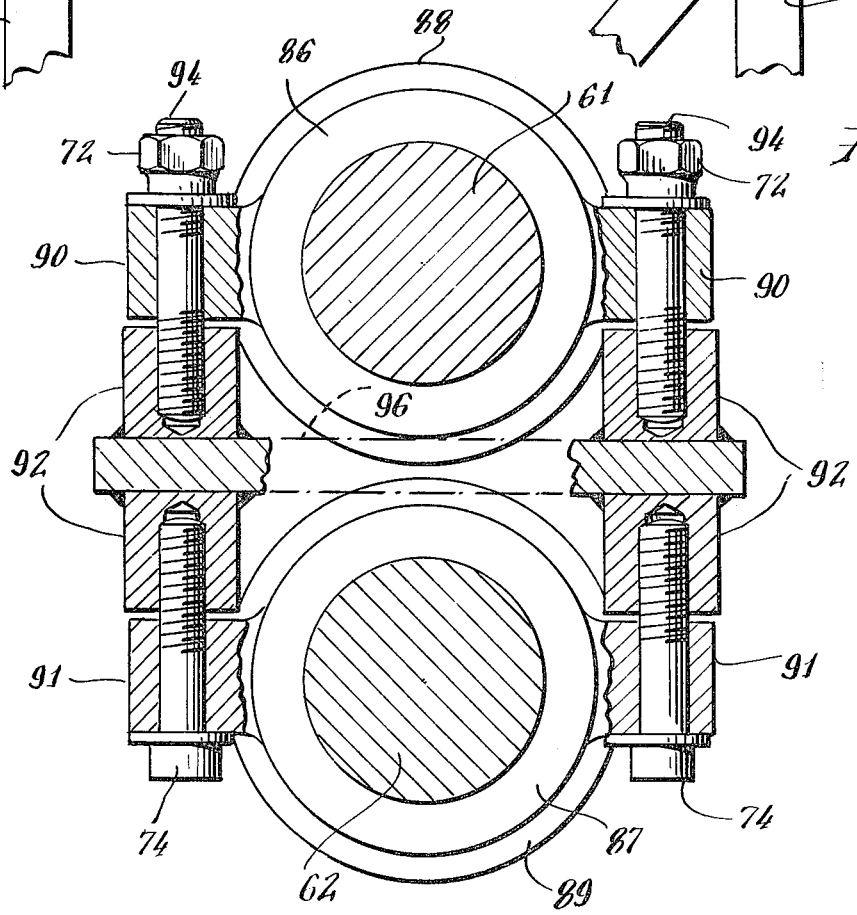
FIG. 5 is a sectional elevational view of the outrigger bearings which may or may not be included on the cantilevered front ends of the spindles in a stand for resisting spreading forces induced during rolling of harder stock, particularly in cases where more severe reductions are being taken in a given stand.

In order to resist the separating forces on the cantilevered front ends of the spindles 61 and 62 caused by the stock 25 passing between the work rolls 63 and 64, a pair of outrigger bearings 86 and 87 (see also FIG. 5) may be mounted on the ends of the spindles. Their bearing housings 88 and 89 have pairs of ears 90 and 91 which are attached to a pair of connector members 92. In actual practice the lower ears 91 are drawn up tightly against the connector members 92 by self-locking cap screws 74. Threaded studs 94 extend up through the ears 90, and self-locking nuts 72 are used to adjust the spacing between the outrigger bearings. These two nuts 72 on the outrigger studs 94 are tightened to correspond with the adjusted position of the two nuts 72 on the front bearing mounting studs 66. Thus, the axes of the work rolls 63 and 64 are held parallel in spite of the separating forces.

The two connector members 92 in the outrigger bearing assembly are joined together by a yoke 96 which has a broad U-shape as seen in plan view in FIG. 3.

In order to support the center spine 52 in its horizontal position, there are four pairs of legs 101, 102, 103 and 104. The lower ends of these legs have foot pads 105 and are secured together by frame members 106, with diagonal bracing 108.

The stock 25 travels along the the pass line through the three successive stands from left to right in FIGS. 2 and 3 as shown by the arrows 108 and 109. As the stock 25 is rolled it is progressively reduced in cross sectional area, and its travel speed increases so that it exits 109 from the mill at a higher velocity than it enters.

In order to drive all of the spindles in the mill 50 there is a main drive unit 110 including an electric motor and a speed-reducing gear box having a main drive output shaft 112 carrying first and second pulley sheaves 113 and 114 (see FIG. 3). The first sheave 113 serves to drive the four spindles in the first two stands I and II (FIG. 2) of this mill 50, while the second sheave 114 drives the two spindles in the third stand III. These drive trains will now be explained.

A multiple-V type of belt 116 transfers mechanical power from the first drive pulley sheave 113 to a driven pulley 117 on the input shaft 118 of a reversing gear box 120. This input shaft 118 extends through the gear box 120 and carries first and second drive sheaves 121 and 122 on its rear end as seen in FIG. 2. From the first drive sheave 121 a belt 124 runs to a driven sheave 125 on the input shaft 126 of a speed-reducing and torque-increasing lower planetary gear unit 128, whose output shaft drives the lower spindle 62 (FIG. 4) in the first stand I.

From the second drive sheave 122 on this shaft 118 a belt 130 runs to a driven sheave 132 on the input shaft 134 of a speed-reducing and torque-increasing lower planetary gear unit 138, whose output shaft drives the lower spindle in the second stand II.

The reversing gear box 120 has an upper shaft 140 counter-rotating relative to its lower shaft 118 and at the same speed on the lower shaft carrying first and drive sheaves 141 and 142 identical to those (121, 122)

on the lower shaft 118. From the first drive sheave 141 a belt 144 runs to a driven sheave 145 on the input shaft 146 of a speed-reducing and torque-increasing upper planetary gear unit 148, whose output shaft drives the upper spindle 61 (FIG. 4) in the first stand I.

From the second drive sheave 142 on the upper shaft 140 a belt 150 runs to a driven sheave 152 on the input shaft 154 of a speed-reducing and torque-increasing upper planetary gear unit 158, whose output shaft drives the upper spindle in the second stand II.

In order to drive the work rolls in the second stand II at a higher peripheral speed than the work rolls in the first stand to match the faster travel of the stock 25 passing through the second stand, the driven pulley sheaves 132 and 154 in the second stand may have smaller diameters than the driven sheaves 125 and 145 in the first stand. Also, for this same purpose, the planetary gear units 138 and 158 in the second stand may have different gear ratios from the planetary gear units 128 and 148 in the first stand.

The two spindles in the third stand III are driven by the second main drive sheave 114 (FIG. 3) on the main drive output shaft 112. A belt 166 (See also FIG. 2) runs from the drive sheave 114 to a driven sheave 167 on the input shaft 168 of a reversing gear box 170. This shaft 168 extends through the reversing gear box 170 and carries a drive sheave 172 on its opposite end, serving to drive a belt 174 running to a driven sheave 175 on the input shaft 176 of a speed-reducing and torque-increasing lower planetary gear unit 178. The output shaft of this planetary gear unit 178 drives the lower spindle in the third stand III.

The reversing gear box 170 has an upper output shaft 180 carrying a drive sheave 182 for driving a belt 184 running to a driven sheave 185 on the input shaft 186 of a speed-reducing torque-increasing upper planetary gear unit 188. The output shaft of this upper planetary gear unit 188 drives the upper spindle in the third stand III. The two spindles in the third stand III are driven at the same rotational speed in opposite directions, their rotational speed being faster than that of the two spindles in the second stand II.

Among the advantages of this drive arrangement as described are that each spindle has its own planetary gear drive unit. Therefore, the gears in the reversing gear units 120 and 170 (FIG. 3) are operating at much higher speeds at lower torques than the mating reversing gears 41 and 42 (FIG. 1) in the prior art mill. Consequently, finer gear teeth can be used in these reversing gear units so that the individual spindles are each driven more smoothly with more constant input torque and more constant speed through their individual planetary gear units.

The foregoing description of an embodiment of the present invention is to be construed as illustrative only, rather than limiting. This invention is limited only by the scope of the following claims and equivalents of the claimed elements.

I claim:

1. A center-spine mounted cantilever tandem rolling mill comprising:

at least three upper spindles each adapted to carry an upper work roll near its front end, at least three lower spindles each adapted to carry a lower work roll near its front end, an upper front bearing surrounding each upper spindle and an upper rear bearing surrounding each upper spindle, with each upper front bearing being positioned on its spindle between the upper rear bearing and the location of the upper work roll on the spindle for rotatably holding the respective upper spindles with the work rolls being in cantilevered relationship beyond the respective upper front bearings, a lower front bearing surrounding each lower spindle and a lower rear bearing surrounding each lower spindle with each lower front bearing being positioned on its spindle between the lower rear bearing and the location of the lower work roll on the spindle for rotatably holding the respective lower spindles with the work rolls being in cantilevered relationship beyond the respective lower front bearings, an elongated rigid center spine extending horizontally midway between the upper and lower spindles, a support frame for supporting said center spine extending horizontally above the floor, upper mounting means on the upper surface of said center spine for removably securing the upper front and upper rear bearings above said center spine with the upper spindles extending perpendicular to the length of said center spine and with the upper work rolls being in cantilevered relationship beyond the front of said center spine, lower mounting means on the lower surface of said center spine for removably securing the lower front and lower rear bearings below said center spine with the lower spindles extending perpendicular to the length of said center spine and with the lower spindles being parallel with and below the upper spindles in paired upper-lower relationship and with the lower work rolls being in cantilevered relationship beyond the front of said center spine, drive means mounted on said frame and connected to all of said spindles for simultaneously driving all of said spindles in tandem relationship, whereby any one of said upper spindles or lower spindles can be individually removed from said center spine without removing any other spindle, and whereby said center spine positioned midway between the upper and lower spindles isolates the respective spindles from rolling stresses occurring in neighboring spindles.

2. The center-spine mounted rolling mill as claimed in claim 1, in which:

said drive means includes a plurality of speed-reducing torque increasing planetary gear units each having an output shaft and an input shaft, the output shafts of the respective planetary gear units being individually directly connected to the respective spindles in the mill, and a main drive mechanically connected to the input shafts of all of said planetary gear units.

3. A center-spine mounted tandem cantilever rolling mill comprising:

an elongated center spine, a support frame for supporting said center spine in horizontal position, at least three mill stands, each mill stand including upper and lower spindles, lower bearing means for rotatably holding said lower spindles, upper bearing means for rotatably holding said upper spindles, mounting means attached to said center spine and removably fastened to said lower bearing means for mounting said lower spindles beneath said center spine extending parallel with each other, and with an end portion of each lower spindle projection horizontally beyond the center spine in cantilevered relationship for carrying a lower work roll thereon, said mounting means being removably fastened to said upper bearing means for mounting said upper spindles above said center spine extending parallel with each other and aligned with the respective lower spindles, and with an end portion of each upper spindle projecting horizontally beyond the center spine in cantilevered relationship for carrying an upper work roll thereon, said center spine being positioned mid-way between the respective lower and upper spindles, and drive means mechanically connected to all of said spindles for rotating them, whereby any one of said upper or lower spindles in each stand can be individually removed from said center spine without removing the other spindle in the stand, and whereby said center spine positioned mid-way between the upper and lower spindles is closely coupled to all of the spindles by relatively short mounting means for rigidly resisting deflection.

4. A center-spine mounted rolling mill as claimed in claim 3, in which:

said drive means includes a plurality of speed-reducing, torque-increasing planetary gear units each having an input shaft and an output shaft, the output shafts of the respective planetary gear units being individually connected to the respective spindles for driving each spindle by its own planetary gear unit, and said drive means including a main drive mechanically connected to the input shafts of all of said planetary gear units for driving them.

5. A center-spine mounted rolling mill as claimed in claim 1, in which:

said elongated rigid center spine is a plate having a generally rectangular configuration as seen in plan view, a support frame holds said plate in horizontal position, and said upper and lower mounting means include bosses welded onto said plate and each having a threaded socket therein.

6. A center-spine mounted rolling mill as claimed in claim 3 in which:

said center spine includes a plate having a generally rectangular configuration as seen in plan view, said mounting means include a plurality of bosses of equal height each welded directly to said plate, and each of said bosses has a threaded socket therein.

7. A center-spine mounted rolling mill as claimed in claim 6, in which:

a plurality of said bosses are welded to the top of said plate, and a plurality of said bosses are welded to the bottom of said plate in alignment with the respective bosses which are welded to the top.

8. A center-spine mounted rolling mill as claimed in claim 3, 4, 6, or 7 in which:

adjustable outrigger bearing means are mounted on the cantilevered ends of the upper and lower spindles in at least one stand of the mill for resisting separating forces resulting from rolling the stock between the work rolls mounted on said cantilevered spindles.

* * * * *